US005199482A

United States Patent [19]

Rühle

[11] Patent Number: 5,199,482

[45] Date of Patent: Apr. 6, 1993

[54] PROCESS FOR MANUFACTURING A CASTING, OF ALUMINUM, PROVIDED WITH A POROUS INSERT

[75] Inventor: Martin Rühle, Stuttgart, Fed. Rep. of Germany

[73] Assignee: Mahle GmbH, Stuttgart, Fed. Rep. of Germany

[21] Appl. No.: 741,398

[22] PCT Filed: Jan. 12, 1990

[86] PCT No.: PCT/DE90/00013

§ 371 Date: Aug. 2, 1991

§ 102(e) Date: Aug. 2, 1991

[87] PCT Pub. No.: WO90/08610

PCT Pub. Date: Aug. 9, 1990

[30] Foreign Application Priority Data

Feb. 4, 1989 [DE] Fed. Rep. of Germany ..... 3903310

[51] Int. Cl.[5] ..... B22D 19/14

[52] U.S. Cl. ..... 164/120; 164/113

[58] Field of Search ..... 164/61, 62, 132, 137, 164/253, 340, 120, 522, 113

[56] References Cited

FOREIGN PATENT DOCUMENTS 0084662 5/1983 Japan ..... 164/120
0102251 6/1985 Japan ..... 164/137
0296938 12/1986 Japan ..... 164/61

*Primary Examiner*—Richard K. Seidel
*Assistant Examiner*—Erik R. Puknys
*Attorney, Agent, or Firm*—Collard & Roe

[57] ABSTRACT

A method for the production of a molded casting, including the steps of providing a mold with a porous insert part which can subsequently be dissolved out. Placing the porous insert part having pores into the mold. Subsequently surrounding the porous insert part by a melt and then putting the melt under pressure. In the pore areas to be kept clear of the melt, gas pressure is maintained on the insert part which is equal to or slightly less than the melt pressure.

2 Claims, 1 Drawing Sheet

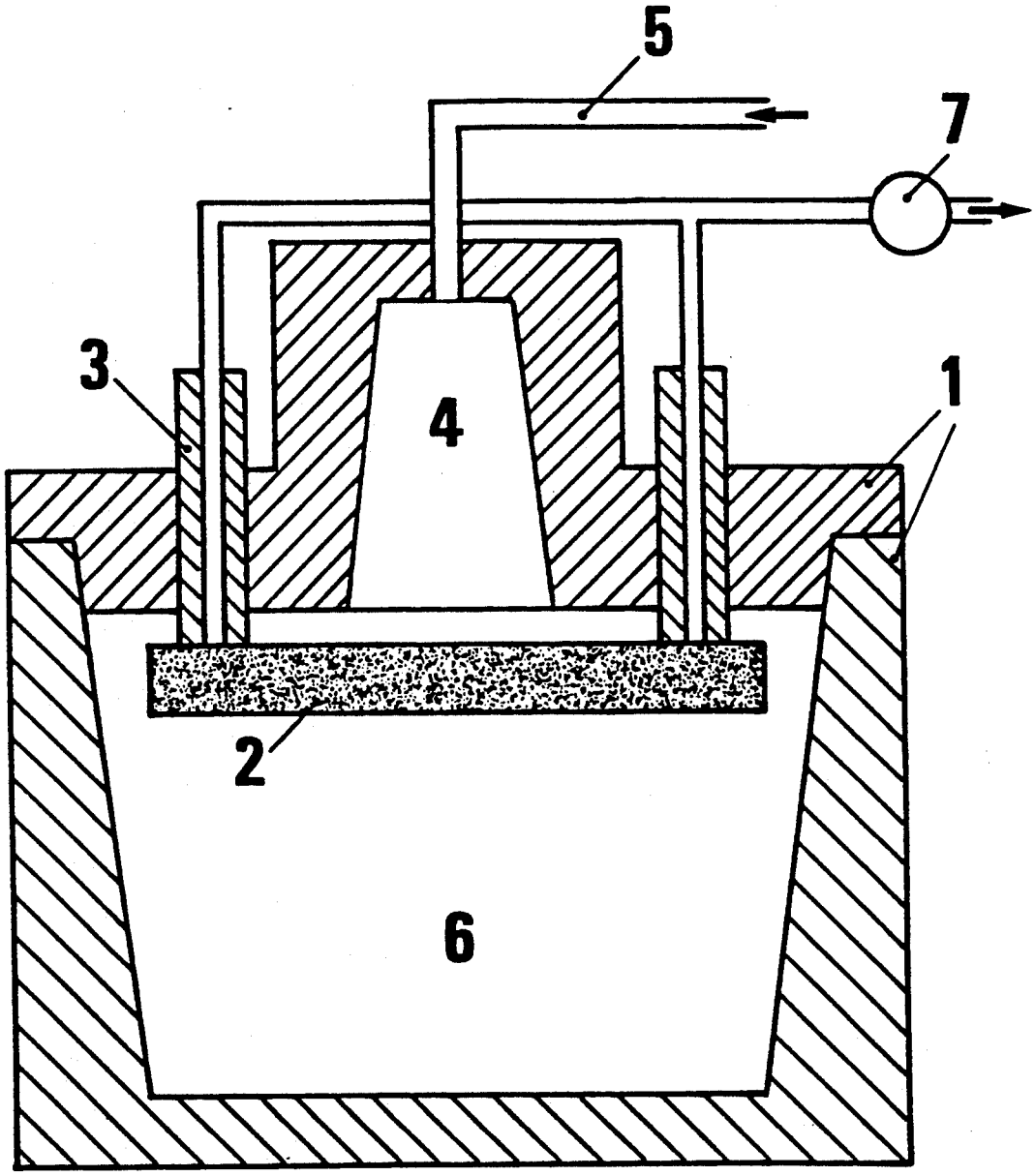
5
7
3
4
1
2
6

PROCESS FOR MANUFACTURING A CASTING, OF ALUMINUM, PROVIDED WITH A POROUS INSERT

The invention relates to a method for the production of a molded casting, particularly made of aluminum, to be provided with a porous insert part which can subsequently be dissolved out.

Such a method, in which such insert parts merely have the purpose of creating cavities in the finished casting, for which purpose the insert parts are removed from the finished casting again, for example by being dissovled out with liquid, is known. In these cases, the insert part is basically not supposed to possess any porosity, but this cannot always be avoided when using a material that can be dissolved out. For example, insert parts produced from pressed salt are used, and these can be easily dissolved out of the finished casting using a liquid. With such pressed salt cores, a slight residual porosity remains, in some cases, into which the melt can penetrate in the surface area, if it is made to solidify under pressure. When the insert part, which served as a casting core, is later dissolved out, this results in an undesirably rough and jagged surface of the cavity to be produced in the casting.

It is an object of the present invention to provide an improvement in the production of a molded casting.

This object is accomplished by providing a method according to the invention wherein a porous insert part is acted upon by a gas pressure equal to the melt penetration pressure acting on the porous insert part.

If an insert part is supposed to have areas which are supposed to be penetrated by the melt, and areas which are not supposed to be penetrated by the melt, then there must be a partition wall between these two areas.

It is a further object of the invention to provide a method for the production of a molded casting comprising: providing a mold with a porous insert part which can subsequently be dissolved out; placing the porous insert part having pores into the mold; subsequently surrounding the porous insert part by a melt; putting the melt under pressure and maintaining a gas pressure on the insert part which is equal to or slightly less than the melt pressure.

An embodiment is shown in the drawing, which shows a mold in cross-section.

In a mold 1, a casting core 2 made of pressed salt, for example, which can be dissolved out and is used to produce a cavity in the casting to be produced, is held in place by means of pipes 3. The feeder 4 of the mold is connected with a compressed air gas line 5. As mold 1 is filled with an aluminum melt 6, the air entering the casting core 2 is discharged to the outside through pipes 3. Then pressurized gas is introduced within the casting core 2 to prevent penetration of melt into the pores of the casting core, by means of a pump 7.

As mentioned above, the casting core capable of being exchanged (released) is held over tubes 3 in a casting mold. This hold can, but is not required to, take place via vacuum pressure applied to tubes 3. However, vacuum pressure applied to tubes 3 has the advantage that casting core 2 can be held relatively simply by tubes 3.

In the production method, aluminum melt 6 is first fed, practically without pressure, into the mold by riser feeder 4. When the mold is filled, whereby casting core 2 is completely surrounded by the molten aluminum melt, a vacuum is no longer applied to tubes 3, due to the use of pump 7. Instead, an overpressure is applied, at the same time, to the melt by duct guide 5 and riser feeder 4. The overpressure applied to the casting core by tubes 3 is set according to the amount of pressure brought about on melt 6 by riser 4. Thus, the overpressure to be applied to casting core 2 over tubes 3 is equal, or somewhat smaller than, the pressure applied to the melt. The overpressure applied to the casting core by tubes 3 will have the effect of preventing melt 6 from entering into the surface into casting core 2, due to the overpressure affecting melt 6.

As discussed above, air admission to casting core 2 is interrupted after filling of the melt into form mold 1. This means that gas from casting core 2 can be discharged to the outside by tubes 3 until pressure is applied to melt 6 by riser feeder 4. This is necessary because gases are formed within casting core 2 when it is heated by the surrounding melt, which gases must be discharged to the outside. This degassing is to be replaced by the application of an over-pressure on casting core 2 by the same tubes 2 when the mold is full, the melt 6 enclosed therein being set under pressure by guide 5 and riser feeder 4.

I claim:

1. A method for the production of a molded casting comprising the steps of:

providing a mold with a porous insert part which can subsequently be dissolved out;

placing the porous insert part having pores into the mold;

subsequently surrounding the porous insert part by a melt;

putting the melt under pressure; and maintaining a gas pressure on the insert part which is equal to or slightly less than the melt pressure.

2. The method as claimed in claim 1, wherein the melt comprises molten aluminum.

* * * * *